US009311852B2

(12) United States Patent
Wang

(10) Patent No.: US 9,311,852 B2
(45) Date of Patent: Apr. 12, 2016

(54) PIXEL CIRCUIT AND ORGANIC LIGHT-EMITTING DISPLAY COMPRISING THE SAME

(71) Applicant: BOE TECHNOLOGY GROUP CO., LTD., Beijing (CN)

(72) Inventor: Ying Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 38 days.

(21) Appl. No.: 14/344,491

(22) PCT Filed: Jun. 18, 2013

(86) PCT No.: PCT/CN2013/077428
§ 371 (c)(1),
(2) Date: Mar. 12, 2014

(87) PCT Pub. No.: WO2014/172973
PCT Pub. Date: Oct. 30, 2014

(65) Prior Publication Data

US 2015/0221251 A1 Aug. 6, 2015

(30) Foreign Application Priority Data

Apr. 27, 2013 (CN) ..... 2013 1 0153391

(51) Int. Cl.
*G09G 3/32* (2006.01)

(52) U.S. Cl.
CPC ..... *G09G 3/3233* (2013.01); *G09G 3/3208* (2013.01); *G09G 2300/0819* (2013.01);
(Continued)

(58) Field of Classification Search
CPC . G09G 3/3233; G09G 3/3208; G09G 3/3258; G09G 2300/0809; G09G 2300/0819; G09G 2300/0852; G09G 2300/0866; G09G 2310/0251; G09G 2320/0233; G09G 2320/043; G09G 2300/0861
USPC ..... 345/76, 77, 690
See application file for complete search history.

(56) References Cited

U.S. PATENT DOCUMENTS 7,414,599 B2 * 8/2008 Chung et al. ..... 345/76
7,564,452 B2 * 7/2009 Komiya ..... G09G 3/006 315/169.1

(Continued)

FOREIGN PATENT DOCUMENTS

CN 101814268 A 8/2010
CN 102708792 10/2012

(Continued)

OTHER PUBLICATIONS

First Office Action issued by the Chinese Patent Office for Chinese Patent Application No. 201310153391.6 dated Sep. 3, 2014, 8pgs.

(Continued)

*Primary Examiner* — Tom Sheng
(74) *Attorney, Agent, or Firm* — Ladas & Parry LLP

(57) ABSTRACT

Provided are a pixel circuit and an organic light-emitting display. The pixel circuit comprises a driving thin film transistor and a light-emitting diode which is connected between a low level input terminal and a high level input terminal of a driving power supply in series, the pixel circuit further comprises a first capacitor and a driving control unit, a first terminal of the first capacitor is electrically connected with a first electrode of the driving thin film transistor through the driving control unit, a second terminal of the first capacitor is connected with a gate of the driving thin film transistor, a second electrode of the driving thin film transistor is electrically connected with the gate of the driving thin film transistor through the driving control unit, the driving control unit is connected with a gate line and a data line. Since respective pixel circuits may output uniform currents, the brightness of light-emitting diodes in the pixel circuits is uniform, and in turn the display brightness of the organic light-emitting display comprising the pixel circuits is uniform.

17 Claims, 3 Drawing Sheets

(52) U.S. Cl.
CPC ..... *G09G2300/0852* (2013.01); *G09G 2300/0861* (2013.01); *G09G 2300/0866* (2013.01); *G09G 2310/0251* (2013.01); *G09G 2320/0233* (2013.01); *G09G 2320/043* (2013.01)

(56) References Cited

U.S. PATENT DOCUMENTS

| | | | | |
|---|---|---|---|---|
| 8,780,102 | B2 * | 7/2014 | Han | 345/208 |
| 2004/0196223 | A1 * | 10/2004 | Kwon | 345/82 |
| 2004/0196239 | A1 * | 10/2004 | Kwon | 345/92 |
| 2005/0007316 | A1 * | 1/2005 | Akimoto et al. | 345/76 |
| 2005/0017934 | A1 * | 1/2005 | Chung | G09G 3/3233 345/82 |
| 2005/0206591 | A1 * | 9/2005 | Wang et al. | 345/76 |
| 2005/0259051 | A1 * | 11/2005 | Lee et al. | 345/76 |
| 2005/0285825 | A1 * | 12/2005 | Eom et al. | 345/76 |
| 2006/0028408 | A1 * | 2/2006 | Kim | 345/76 |
| 2006/0038754 | A1 * | 2/2006 | Kim | 345/76 |
| 2007/0045620 | A1 * | 3/2007 | Park et al. | 257/40 |
| 2007/0063935 | A1 * | 3/2007 | Yoshida | 345/76 |
| 2007/0268220 | A1 * | 11/2007 | Lee et al. | 345/76 |
| 2008/0211397 | A1 | 9/2008 | Choi | |
| 2009/0237332 | A1 * | 9/2009 | Choi | 345/76 |
| 2010/0053233 | A1 * | 3/2010 | Ishiguro et al. | 345/690 |
| 2011/0050741 | A1 * | 3/2011 | Jeong | 345/690 |
| 2011/0090208 | A1 * | 4/2011 | Long et al. | 345/211 |
| 2011/0134100 | A1 | 6/2011 | Chung et al. | |
| 2011/0193855 | A1 * | 8/2011 | Han | 345/214 |
| 2011/0193856 | A1 * | 8/2011 | Han | 345/214 |
| 2011/0279437 | A1 * | 11/2011 | Komiya et al. | 345/212 |
| 2012/0146979 | A1 * | 6/2012 | Kim et al. | 345/211 |
| 2013/0127924 | A1 * | 5/2013 | Lee | 345/690 |
| 2013/0286000 | A1 * | 10/2013 | Han et al. | 345/212 |
| 2014/0055325 | A1 | 2/2014 | Qi et al. | |

FOREIGN PATENT DOCUMENTS

| | | | |
|---|---|---|---|
| CN | 102708793 | A | 10/2012 |
| CN | 102930824 | A | 2/2013 |
| CN | 203325407 | U | 12/2013 |

OTHER PUBLICATIONS

English translation of First Office Action issued by the Chinese Patent Office for Chinese Patent Application No. 201310153391.6 dated Sep. 3, 2014, 7pgs.

International Search Report for International Application No. PCT/CN2013/077428, 13pgs.

Chinese Patent Certificate Appln. No. CN103226931B; Dated Sep. 9, 2015.

International Preliminary Report on Patentability Appln. No. PCT/CN2013/077428; Dated Oct. 27, 2015.

* cited by examiner

PIXEL CIRCUIT AND ORGANIC LIGHT-EMITTING DISPLAY COMPRISING THE SAME

CROSS REFERENCE TO RELATED APPLICATIONS

This application is based on International Application No. PCT/CN2013/077428 filed on Jun. 18, 2013, which claims priority to Chinese National Application No. 201310153391.6 filed on Apr. 27, 2013. The entire contents of each and every foregoing application are incorporated herein by reference.

TECHNICAL FIELD

The present disclosure relates to a field of organic light-emitting display, and particularly to a pixel circuit and an organic light-emitting display comprising the same.

BACKGROUND

In an Active Matrix Organic Light Emitting Diode (AMOLED) display panel, the emission brightness of an OLED (Organic Light Emitting Diode) is directly proportional to an amplitude of a driving current supplied thereto. A great driving current is required to realize an optimal display effect. A Low Temperature Poly-Silicon technique has become an optimal selection for the AMOLED display panel because it may provide a high mobility. However an inherent problem of shifts in threshold voltages Vth of thin film transistors existed in the Low Temperature Poly-Silicon technique may cause non-uniformity in currents output from respective pixel circuits, such that the display brightness is also non-uniform.

Therefore, how to improve the uniformity in the currents output from the respective pixel circuits is a technical problem needed to be settled urgently in the art.

SUMMARY

An object of the present disclosure is to provide a pixel circuit and an organic light-emitting display comprising the same. Respective pixel circuits may output uniform currents, so that the brightness of light-emitting diodes in the respective pixel circuits may be uniform, and in turn the organic light-emitting display comprising the pixel circuits may have a uniform display brightness.

According to an aspect of the present disclosure, there is provided a pixel circuit comprising a driving thin film transistor and a light-emitting diode which is connected between a low level input terminal and a high level input terminal of a driving power supply in series, wherein the pixel circuit further comprises a first capacitor and a driving control unit, a first terminal of the first capacitor is electrically connected with a first electrode of the driving thin film transistor through the driving control unit, a second terminal of the first capacitor is connected with a gate of the driving thin film transistor, a second electrode of the driving thin film transistor is electrically connected with the gate of the driving thin film transistor through the driving control unit, the driving control unit is connected with a gate line and a data line, and during a data writing stage, the driving control unit controls to connect the first terminal of the first capacitor to the first electrode of the driving thin film transistor and connect the gate of the driving thin film transistor to the second electrode of the driving thin film transistor, such that the driving thin film transistor is turned on.

Optionally, the pixel circuit may further comprise a second capacitor, a first terminal thereof is connected with the second terminal of the first capacitor, and a second terminal thereof is electrically connected with the data line through the driving control unit.

Optionally, the driving control unit may further comprise a first driving control transistor, a gate thereof is connected with the gate line, a first electrode thereof is connected with the data line, and a second electrode thereof is connected with the second terminal of the second capacitor.

Optionally, the pixel circuit may further comprise an initialization unit for providing a low level and connected to the second terminal of the first capacitor and the first terminal of the second capacitor.

Optionally, the initialization unit may comprise an initialization transistor, a first electrode thereof is connected with the second terminal of the first capacitor and the first terminal of the second capacitor, a second electrode thereof is connected with the low level input terminal, and a gate thereof is connected with a reset signal input terminal.

Optionally, the driving control unit may comprise a second driving control transistor and a third driving control transistor, a gate of the second driving control transistor is connected with the gate line, a first electrode of the second driving control transistor is connected with the second electrode of the driving thin film transistor, a second electrode of the second driving control transistor is connected with the gate of the driving thin film transistor, a gate of the third driving control transistor is connected with the gate line, a first electrode of the third driving control transistor is connected with the first terminal of the first capacitor, and a second electrode of the third driving control transistor is connected with the first electrode of the driving thin film transistor.

Optionally, the pixel circuit may further comprise a light-emitting control unit which is connected with a light-emitting control line and is capable of connecting the high level input terminal of the driving power supply to the first electrode of the driving thin film transistor, and/or connecting the low level input terminal of the driving power supply to the second electrode of the driving thin film transistor, according to a signal supplied from the light-emitting control line.

Optionally, the light-emitting control unit may comprise a first light-emitting control transistor and a second light-emitting control transistor, a gate of the first light-emitting control transistor is connected with the light-emitting control line, a first electrode of the first light-emitting control transistor is connected with the first electrode of the driving thin film transistor, a second electrode of the first light-emitting control transistor is connected with the high level input terminal of the driving power supply, a gate of the second light-emitting control transistor is connected with the light-emitting control line, a first electrode of the second light-emitting control transistor is connected with the second electrode of the driving thin film transistor, a second electrode of the second light-emitting control transistor is connected with an anode of the light-emitting diode, and a cathode of the light-emitting diode is connected with the low level input terminal of the driving power supply.

Optionally, the driving thin film transistor, the first driving control transistor, the second driving control transistor, the third driving control transistor, the initialization transistor, the first light-emitting control transistor and the second light-emitting control transistor are all P-type transistors.

According to another aspect of the present disclosure, there is further provided an organic light-emitting display, wherein the organic light-emitting display comprises the above pixel circuit according to the present disclosure.

In the pixel circuit according to the present disclosure, during the data writing stage of the pixel circuit, the driving control unit controls to connect the first terminal of the first capacitor to the first electrode of the driving thin film transistor and connect the gate of the driving thin film transistor to the second electrode of the driving thin film transistor, thus the driving thin film transistor actually forms a diode being in a critical conduction state at this time. A gate voltage $V_g$ of the driving thin film transistor may be a difference obtained by subtracting a threshold voltage $V_{th,DTFT}$ of the driving thin film transistor from a voltage $V_{N1}$ at the second terminal of the first capacitor (that is, $V_g=V_{N1}-V_{th,DTFT}$). During this data writing stage, the first capacitor records the gate voltage of the driving thin film transistor and holds it till a light-emitting stage of the light-emitting diode in the pixel circuit. During the light-emitting stage of the light-emitting diode OLED in the pixel circuit, the driving thin film transistor is in a saturation state, the gate voltage of the driving thin film transistor is the voltage held on the first capacitor, that is, $V_{N1}-V_{th,DTFT}$, and a voltage $V_{gs}$ between the gate and the first electrode of the driving thin film transistor is a difference between a voltage $V_{dd}$ input from the first electrode of the driving thin film transistor and the gate voltage of the driving thin film transistor, that is, $V_{gs}=V_{dd}-(V_{N1}-V_{th,DTFT})$. An equation for calculating a drain current of the driving thin film transistor is as follows:

$$\begin{aligned} I_d &= \frac{1}{2}\mu C_{ox}(W/L)(|V_{gs,DTFT}|-|V_{th,DTFT}|)^2 \\ &= \frac{1}{2}\mu C_{ox}(W/L)[V_{dd}-(V_{N1}-V_{th,DTFT})-V_{th,DTFT}]^2 \\ &= \frac{1}{2}\mu C_{ox}(W/L)(V_{dd}-V_{N1})^2. \end{aligned}$$

It can be seen from the above equation that the drain current of the driving thin film transistor is independent of the threshold voltage of the driving thin film transistor (in other words, the threshold voltage of the driving thin film transistor is compensated) during the light-emitting stage of the light-emitting diode, so that the problems of non-uniform brightness and brightness decay in the AMOLED panel are settled.

BRIEF DESCRIPTION OF THE DRAWINGS

Drawings, which constitute a part of the specification, are provided to assistant to further understand the present disclosure and are used to explain the present disclosure together with following detailed implementations, but should not be constructed as limitations on the present disclosure. Wherein.

| Reference Signs | |
|---|---|
| 10: driving control unit | 20: light-emitting control unit |
| 30: initialization unit | EM: light-emitting control line |
| C1: first capacitor | C2: second capacitor |
| T1: first driving control transistor | T2: second driving control transistor |
| T3: initialization transistor | T4: second light-emitting control transistor |
| T5: first light-emitting control transistor | T6: third driving control transistor |
| DTFT: driving thin film transistor | OLED: light-emitting diode |
| GATE: gate line | DATA: data line |
| ELVDD: high level input terminal of a driving power supply | |
| ELVSS: low level input terminal of the driving power supply | |
| RESET: reset signal input terminal | |

DETAILED DESCRIPTION

Detailed implementations of the present disclosure will be described in details below in connection with the drawings. It should be understood that the detailed implementations described herein are only used for illustrating and explaining the present disclosure, instead of limiting the present disclosure.

Figure 1:
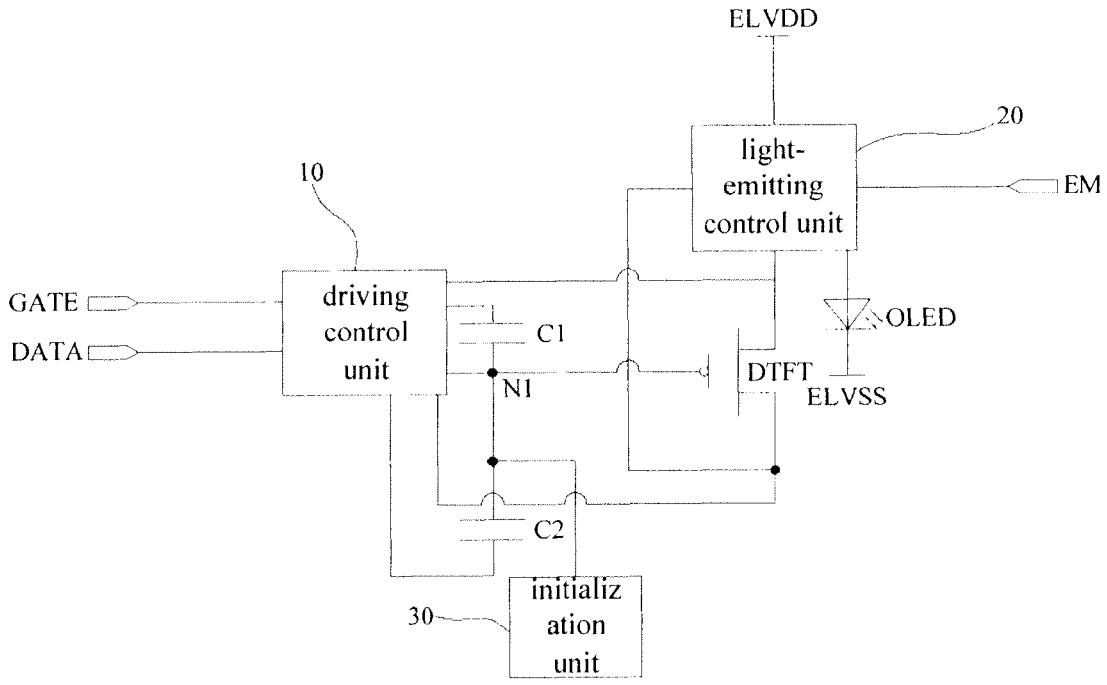
FIG. 1 is a circuit diagram illustrating a first implementation of a pixel circuit according to the present disclosure.

In embodiments of the present disclosure, there is provided a pixel circuit, as illustrated in FIG. 1, the pixel circuit comprises a driving thin film transistor DTFT and a light-emitting diode OLED which is connected between a low level input terminal ELVSS and a high level input terminal ELVDD of a driving power supply in series.

In an example, the pixel circuit further comprises a first capacitor C1 and a driving control unit 10, a first terminal of the first capacitor C1 is electrically connected with a first electrode (one of a source and a drain of the driving thin film transistor DTFT) of the driving thin film transistor DTFT through the driving control unit 10, a second terminal of the first capacitor C1 is connected with a gate of the driving thin film transistor DTFT, a second electrode (the other of the source and the drain of the driving thin film transistor DTFT) of the driving thin film transistor DTFT is electrically connected with the gate of the driving thin film transistor DTFT through the driving control unit 10, the driving control unit 10 is connected with a gate line GATE and a data line DATA, and during a data writing stage (that is, a t2 stage in FIG. 3), the driving control unit 10 controls to connect the first terminal of the first capacitor C1 to the first electrode of the driving thin film transistor DTFT and connect the gate of the driving thin film transistor DTFT to the second electrode of the driving thin film transistor DTFT, and further controls to turn on the driving thin film transistor DTFT.

Those skilled in the art should understand that the first electrode and the second electrode of the driving thin film transistor DTFT are connected between the low level input terminal ELVSS and the high level input terminal ELVDD of the driving power supply in series. During other stages except for the data writing stage, the gate of the driving thin film transistor DTFT is disconnected from the first electrode of the driving thin film transistor DTFT, and the gate of the driving thin film transistor DTFT is also disconnected from the second electrode of the driving thin film transistor DTFT.

Figure 3:
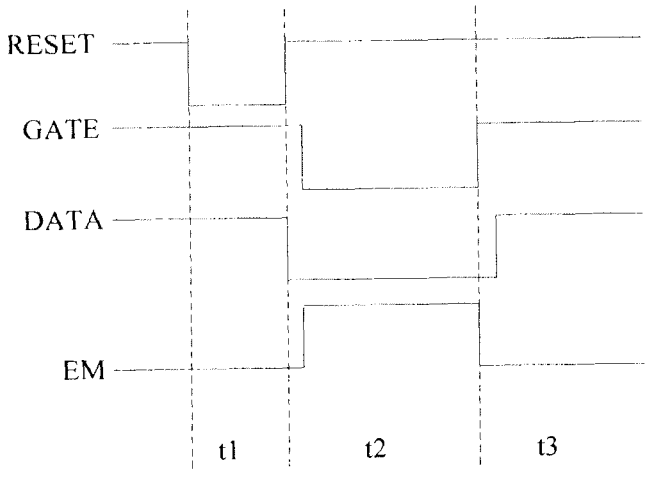
FIG. 3 is a timing diagram of control signals in the pixel circuit according to the present disclosure.

During the data writing stage, signals input from the gate line GATE and the data line DATA are active (as illustrated in FIG. 3), the driving control unit 10 enables to connect the first terminal of the first capacitor C1 to the first electrode of the driving thin film transistor DTFT and connect the gate of the driving thin film transistor DTFT to the second electrode of the driving thin film transistor DTFT, thus the driving thin film transistor DTFT actually forms a diode being in a critical conduction state at this time, and the threshold voltage $V_{th,DTFT}$ of the driving thin film transistor DTFT at this time is recorded and stored by the first capacitor C1.

A gate voltage of the driving thin film transistor DTFT is $V_{N1}-V_{th,DTFT}$ at this time, herein $V_{N1}$ refers to a voltage at a node N1 at which the second terminal of the first capacitor C1 is connected to the data line DATA, and $V_{N1}$ is independent of the threshold voltage $V_{th,DTFT}$ of the driving thin film transistor DTFT. During a light-emitting stage of the light-emitting diode OLED (that is, a t3 stage in FIG. 3), the gate voltage $V_{N1}-V_{th,DTFT}$ of the driving thin film transistor DTFT is held by the first capacitor C1, therefore a current $I_d$ flowing through the first electrode of the driving thin film transistor DTFT and the second electrode of the driving thin film transistor DTFT (that is, a current flowing through the source and the drain of the driving thin film transistor) is as follows:

$$\begin{aligned} I_d &= \frac{1}{2}\mu C_{ox}(W/L)(|V_{gs,DTFT}| - |V_{th,DTFT}|)^2 \\ &= \frac{1}{2}\mu C_{ox}(W/L)[V_{dd} - (V_{N1} - V_{th,DTFT}) - V_{th,DTFT}]^2 \\ &= \frac{1}{2}\mu C_{ox}(W/L)(V_{dd} - V_{N1})^2, \end{aligned}$$

wherein μ is a field effect mobility of the driving thin film transistor DTFT; $C_{ox}$ is a capacitance value of an unit area in an insulation layer at the gate of the driving thin film transistor DTFT; W is a channel width of the driving thin film transistor DTFT; L is a channel length of the driving thin film transistor DTFT; and $V_{dd}$ is a voltage input from the high level input terminal of the driving power supply.

It can be seen from above that the current $I_d$ flowing through the first electrode of the driving thin film transistor DTFT and the second electrode of the driving thin film transistor DTFT is independent of the threshold voltage $V_{th,DTFT}$ of the driving thin film transistor DTFT. Therefore a shift in the threshold voltage $V_{th,DTFT}$ of the driving thin film transistor DTFT would not affect a current output from the driving thin film transistor DTFT (that is, a drain current of the driving thin film transistor DTFT), so that the brightness of the light-emitting diode OLED would not be affected.

In an example, the pixel circuit may further comprise a second capacitor C2, a first terminal thereof is connected with the second terminal of the first capacitor C1, and a second terminal thereof is electrically connected with the data line DATA through the driving control unit 10.

During the data writing stage (that is, the t2 stage shown in FIG. 3), the data line DATA charges the second capacitor C2 through the driving control unit 10. During the light-emitting stage of the light-emitting diode OLED (that is, the t3 stage shown in FIG. 3), the second capacitor C2 insulates the gate of the driving thin film transistor DTFT from the data line DATA so as to prevent a current leakage.

In order to further prevent the current leakage of the gate of the driving thin film transistor DTFT during the light-emitting stage of the light-emitting diode OLED (the t3 stage), in an example, the driving control unit 10 may further comprise a first driving control transistor T1.

A gate of the first driving control transistor T1 is connected with the gate line GATE, a first electrode thereof (one of a source and a drain of the first driving control transistor T1) is connected with the data line DATA, and a second electrode thereof (the other of the source and the drain of the first driving control transistor T1) is connected with the second terminal of the second capacitor C2.

During the data writing stage (that is, the t2 stage shown in FIG. 3), the signal of the gate line GATA and the signal of the data line DATA are active, the first driving control transistor T1 is turned on (the first electrode and the second electrode of the first driving control transistor T1 are connected with each other), the data line DATA charges the second capacitor C2 through the first driving control transistor T1. During the light-emitting stage of the light-emitting diode OLED (that is, the t3 stage shown in FIG. 3), the first driving control transistor T1 is turned off (that is, the source and the drain of the first driving control transistor T1 is disconnected from each other), so that the current leakage of the gate of the driving thin film transistor DTFT to the data line DATA may be prevented.

In order to eliminate an affect on the driving thin film transistor DTFT by residual quantity of electric charges on the first capacitor C1 and the second capacitor C2, in an example, the pixel circuit may further comprise an initialization unit 30 for providing a low level.

The initialization unit 30 is electrically connected to a common terminal of the first capacitor C1 and the second capacitor C2, the second terminal of the first capacitor C1 and the first terminal of the second capacitor C2 form the common terminal. Before the data writing stage (that is, before the t2 stage shown in FIG. 3), an initialization stage (that is, a t1 stage shown in FIG. 3) may be performed at first, so that the first capacitor C1 and the second capacitor C2 are discharged by the initialization unit 30, in order to complete an initialization of the pixel circuit.

Figure 2:
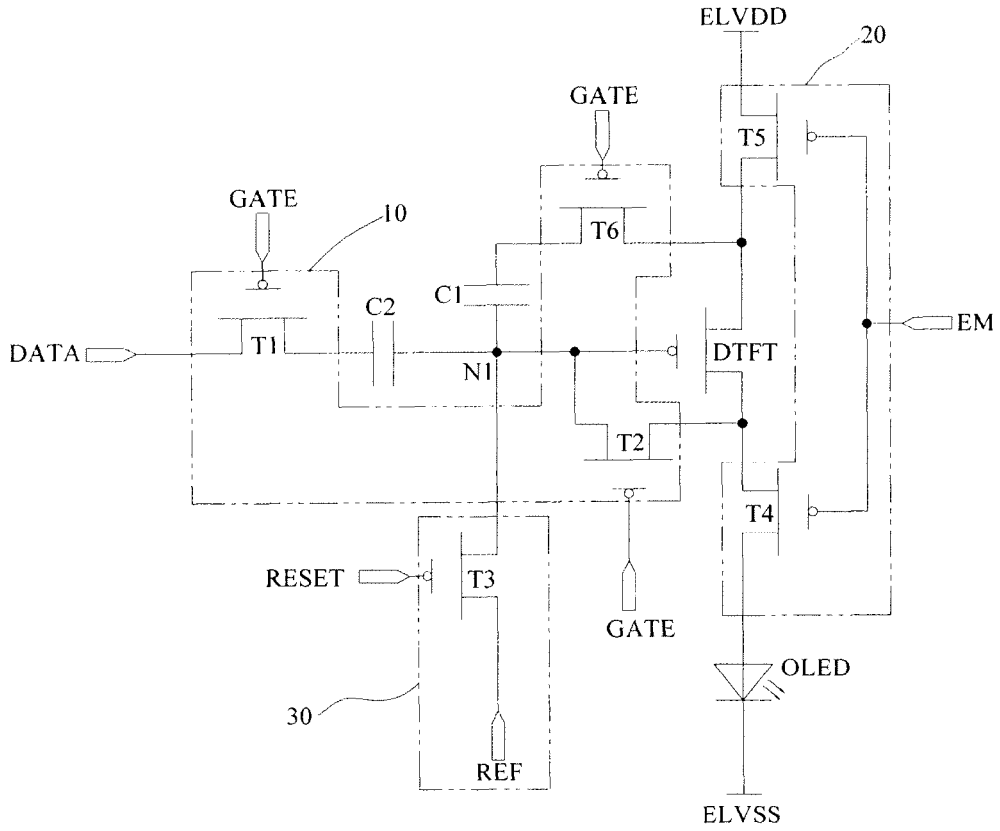
FIG. 2 is a circuit diagram illustrating a second implementation of the pixel circuit according to the present disclosure.

In particular, as illustrated in FIG. 2, the initialization unit 30 may comprise an initialization transistor T3, a first electrode thereof (one of a source and a drain of the initialization transistor T3) is connected between the second terminal of the first capacitor C1 and the first terminal of the second capacitor C2, a second electrode thereof (the other of the source and the drain of the initialization transistor T3) is connected with a low level input terminal REF (this low level input terminal REF may provide the low level), and a gate thereof is connected with a reset signal input terminal RESET. During the initialization stage (the t1 stage), a reset signal input from the reset signal input terminal RESET is active, the initialization transistor T3 is turned on so as to discharge the first capacitor C1 and the second capacitor C2, thus a state initialization of the pixel circuit is completed.

As a detailed implementation, in an example, as illustrated in FIG. 2, the driving control unit 10 may further comprise a second driving control transistor T2 and a third driving control transistor T6.

A gate of the second driving control transistor T2 is connected with the gate line GATE, a first electrode of the second driving control transistor T2 (one of a source and a drain of the second driving control transistor T2) is connected with the second electrode of the driving thin film transistor DTFT, a second electrode of the second driving control transistor T2 (the other of the source and the drain of the second driving control transistor T2) is connected with the gate of the driving thin film transistor DTFT, a gate of the third driving control transistor T6 is connected with the gate line GATE, a first electrode of the third driving control transistor T6 (one of a source and a drain of the third driving control transistor T6) is connected with the first terminal of the first capacitor C1, and a second electrode of the third driving control transistor T6 (the other of the source and the drain of the third driving control transistor T6) is connected with the first electrode of the driving thin film transistor DTFT.

During the data writing stage (that is, the t2 stage shown in FIG. 3), the signals from the gate line GATE and the data line DATA are active, the second driving control transistor T2 and the third driving control transistor T6 are turned on, so that the driving thin film transistor DTFT forms a diode. During the initialization stage (that is, the t1 stage shown in FIG. 3) and the light-emitting stage of the light-emitting diode OLED (the t3 stage), the second driving control transistor T2 and the third driving control transistor T6 are turned off.

As described above, the light-emitting diode OLED is connected between the low level input terminal ELVSS and the high level input terminal ELVDD of the driving power supply in series, and the first electrode and the second electrode of the driving thin film transistor DTFT are also connected between the low level input terminal ELVSS and the high level input terminal ELVDD of the driving power supply in series. When the driving thin film transistor DTFT is turned on, the current may flow to the low level input terminal ELVSS of the driving power supply to the high level input terminal ELVDD of the driving power supply so as to flow through the light-emitting diode OLED and drive the light-emitting diode OLED to emit light.

In order to facilitate controlling of the light-emitting diode OLED, as illustrated in FIG. 2, generally the pixel circuit may further comprise a light-emitting control unit 20, which is connected with a light-emitting control line EM and may connect the high level input terminal ELVDD of the driving power supply to the first electrode of the driving thin film transistor DTFT and/or connect the low level input terminal ELVSS of the driving power supply to the second electrode of the driving thin film transistor DTFT, according to a signal supplied from the light-emitting control line EM.

During the light-emitting stage of the light-emitting diode OLED (that is, the t3 stage shown in FIG. 3), only a signal from the light-emitting control line EM is active, and the driving thin film transistor DTFT is disconnected with both of the gate line GATE and the data line DATA at this time. Since the first capacitor C1 holds the gate voltage of the driving thin film transistor DTFT, the driving thin film transistor DTFT is in a conduction state. Also, since the signal from the light-emitting control line EM is active, the current supplied from the driving power supply may flow to the low level input terminal ELVSS from the high level input terminal ELVDD, so that the light-emitting diode OLED may emit light.

During other stages except for the light-emitting stage of the light-emitting diode OLED (that is, the t3 stage shown in FIG. 3), the high level input terminal ELVDD and the low level input terminal ELVSS of the driving power supply are disconnected with each other, therefore the light-emitting diode OLED does not emit light.

As a detailed implementation, as illustrated in FIG. 2, the light-emitting control unit 20 may comprise a first light-emitting control transistor T5 and a second light-emitting control transistor T4, a gate of the first light-emitting control transistor T5 is connected with the light-emitting control line EM, a first electrode of the first light-emitting control transistor T5 (one of a source and a drain of the first light-emitting control transistor T5) is connected with the first electrode of the driving thin film transistor DTFT, a second electrode of the first light-emitting control transistor T5 (the other of the source and the drain of the first light-emitting control transistor T5) is connected with the high level input terminal ELVDD of the driving power supply, a gate of the second light-emitting control transistor T4 is connected with the light-emitting control line EM, a first electrode of the second light-emitting control transistor T4 (one of a source and a drain of the second light-emitting control transistor T4) is connected with the second electrode of the driving thin film transistor DTFT, a second electrode of the second light-emitting control transistor T4 (the other of the source and the drain of the second light-emitting control transistor T4) is connected with an anode of the light-emitting diode OLED, and a cathode of the light-emitting diode OLED is connected with the low level input terminal ELVSS of the driving power supply.

In another embodiment of the present disclosure, the light-emitting diode OLED may further be connected between the first electrode of the first light-emitting control transistor T5 and the first electrode of the driving thin film transistor DTFT in series.

In a case that the signal of the light-emitting control line EM is active, the first light-emitting control transistor T5 and the second light-emitting control transistor T4 are both turned on, the current may flow to the low level input terminal ELVSS of the driving power supply from the high level input terminal ELVDD of the driving power supply, so that the light-emitting diode OLED may emit light.

During the other stages (that is, the t1 stage and the t2 stage shown in FIG. 3) except for the light-emitting stage of the light-emitting diode OLED (that is, the t3 stage shown in FIG. 3), the first light-emitting control transistor T5 is turned off, the high level input terminal ELVDD of the driving power supply is disconnected from the first electrode of the driving thin film transistor DTFT, so that a high level of the high level input terminal ELVDD of the driving power supply is prevented from affecting the first electrode of the driving thin film transistor DTFT.

During the data writing stage (that is, the t2 stage shown in FIG. 3), because the gate of the driving thin film transistor DTFT is connected with the second electrode of the driving thin film transistor DTFT, the driving thin film transistor DTFT actually forms a diode being in a critical conduction state at this time, therefore the second light-emitting control transistor T4 is turned off, so that a current leakage current from the driving thin film transistor DTFT may be prevented from flowing to the light-emitting diode OLED.

In the present disclosure, no limitation is made for types of the driving thin film transistor DTFT, the first driving control transistor T1, the second driving control transistor T2, the third driving control transistor T6, the initialization transistor T3, the first light-emitting control transistor T5 and the second light-emitting control transistor T4. However, the first driving control transistor T1, the second driving control transistor T2 and the third driving control transistor T3 should have a same type (all being P-type or all being N-type), while the first light-emitting control transistor T5 and the second light-emitting control transistor T4 should have a same type (all being P-type or all being N-type).

In the implementation illustrated in FIG. 2 of the present disclosure, the driving thin film transistor DTFT, the first driving control transistor T1, the second driving control transistor T2, third driving control transistor T6, the initialization transistor T3, the first light-emitting control transistor T5 and the second light-emitting control transistor T4 are all P-type transistors. Active signals for the gate line GATE, the date line DATA and the light-emitting control line EM are the low level signal.

An operation principle of an implementation according to the present disclosure will be discussed below in connection with FIGS. 2, 4-6.

Figure 4:
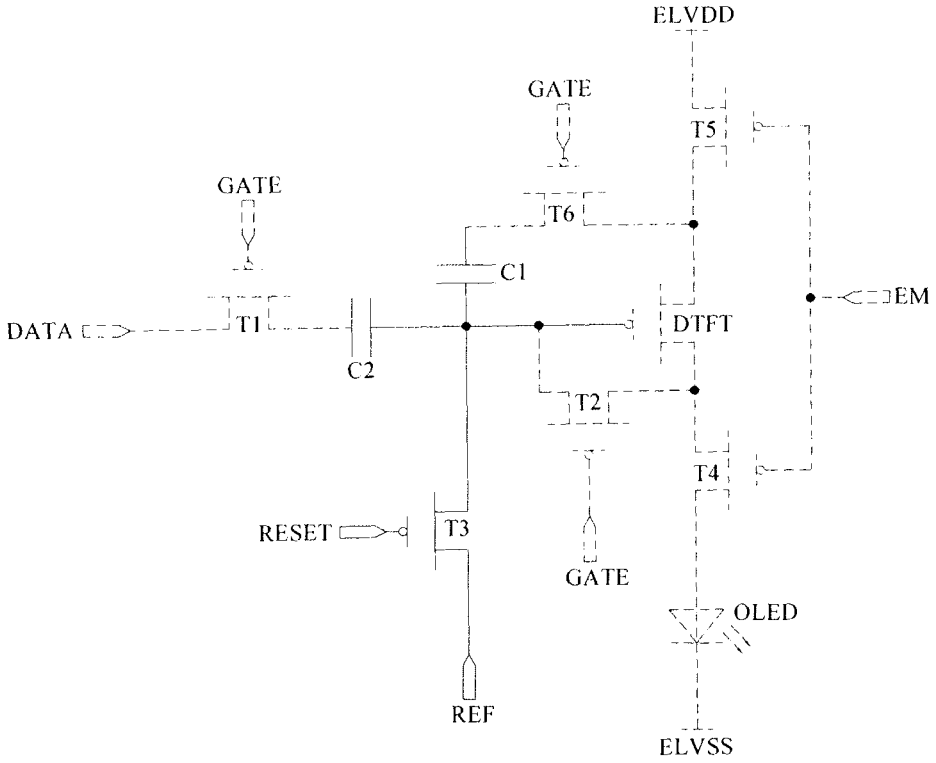
FIG. 4 is an equivalent circuit diagram of the pixel circuit shown in FIG. 2 during a t1 stage.

FIG. 4 illustrates an equivalent circuit diagram of the pixel circuit shown in FIG. 2 during the initialization stage (that is, the t1 stage shown in FIG. 3), wherein parts drawn with solid lines denote powered-on parts while parts drawn with dotted lines denote powered-off parts.

During the initialization stage, the reset signal input terminal RESET supplies the initialization transistor T3 with an active signal in order to turn on the initialization transistor T3, so that the residual quantity of electric charges in the first capacitor C1 and the second capacitor C2 flow to the low level input terminal REF. At this time, the gate voltage of the driving thin film transistor DTFT is a voltage $V_{ref}$ provided from the low level input terminal REF, and a voltage at the first terminal of the second capacitor C2 is also the voltage $V_{ref}$ provided from the low level input terminal REF.

Figure 5:
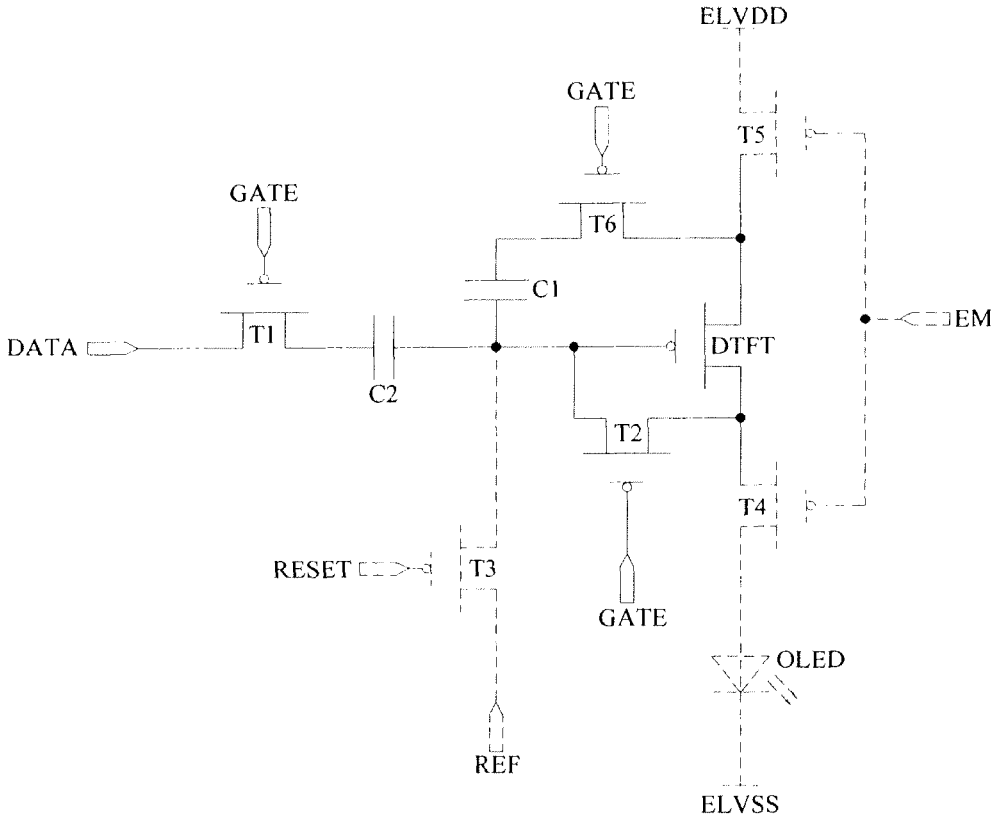
FIG. 5 is an equivalent circuit diagram of the pixel circuit shown in FIG. 2 during a t2 stage.

FIG. 5 illustrates an equivalent circuit diagram of the pixel circuit shown in FIG. 2 during the data writing stage (that is, the t2 stage shown in FIG. 3), similar to the FIG. 4, parts drawn with solid lines denote powered-on parts while parts drawn with dotted lines denote powered-off parts.

During the data writing stage (that is, the t2 stage shown in FIG. 3), the signal input from the reset signal input terminal RESET jumps to a high level, the initialization transistor T3 is turned off, and the first capacitor C1 holds the voltage $V_{ref}$ provided from the low level input terminal REF. At the same time, the signal of the gate line GATE is active, the first driving control transistor T1 is turned on, the data line DATA writes a display data signal into the pixel circuit, at this time, a voltage at the node N1 being the first terminal of the second capacitor C2 is a sum of a voltage $V_{data}$ of the data line DATA and the voltage $V_{ref}$ provided from the low level input terminal REF, that is, $V_{data}+V_{ref}$. At a same time, because the signal of the gate line GATE is active, the second driving control transistor T2 is turned on, so that the gate of the driving thin film transistor DTFT is connected with the second electrode of the driving thin film transistor DTFT, and the driving thin film transistor DTFT actually forms a diode being in a critical conduction state at this time, thus the threshold voltage $V_{th,DTFT}$ of the driving thin film transistor DTFT is held and recorded by the first capacitor C1. At this time, the gate voltage of the driving thin film transistor is $V_{data}+V_{ref}-V_{th,DTFT}$ and is stored by the first capacitor C1.

During the data writing stage (that is, the t2 stage shown in FIG. 3), the light-emitting control line EM is in a high level, the second light-emitting control transistor T4 is turned off, thus an action for writing the data into the pixel would not affect a light-emitting state of the light-emitting diode OLED, which may avoid flickers in the display. At the same time, the high level of the light-emitting control line EM ensures that the first light-emitting control transistor T5 is turned off, ensures that the driving thin film transistor DTFT is disconnected from the high level input terminal ELVDD of the driving power supply at this moment, which may avoid a harmful effect on the gate voltage of the driving thin film transistor DTFT caused by the current leakage of the driving thin film transistor DTFT. On the other hand, the signal of the gate line GATE is active, the third driving control transistor T6 is turned on, so that the first electrode of the driving thin film transistor DTFT is prevented from being float, and the third driving control transistor T6 may introduce the gate voltage of the driving thin film transistor DTFT to the first electrode of the driving thin film transistor DTFT, thus the gate voltage of the driving thin film transistor DTFT would not be affected even if a current leakage phenomenon occurs in the driving thin film transistor DTFT.

Figure 6:
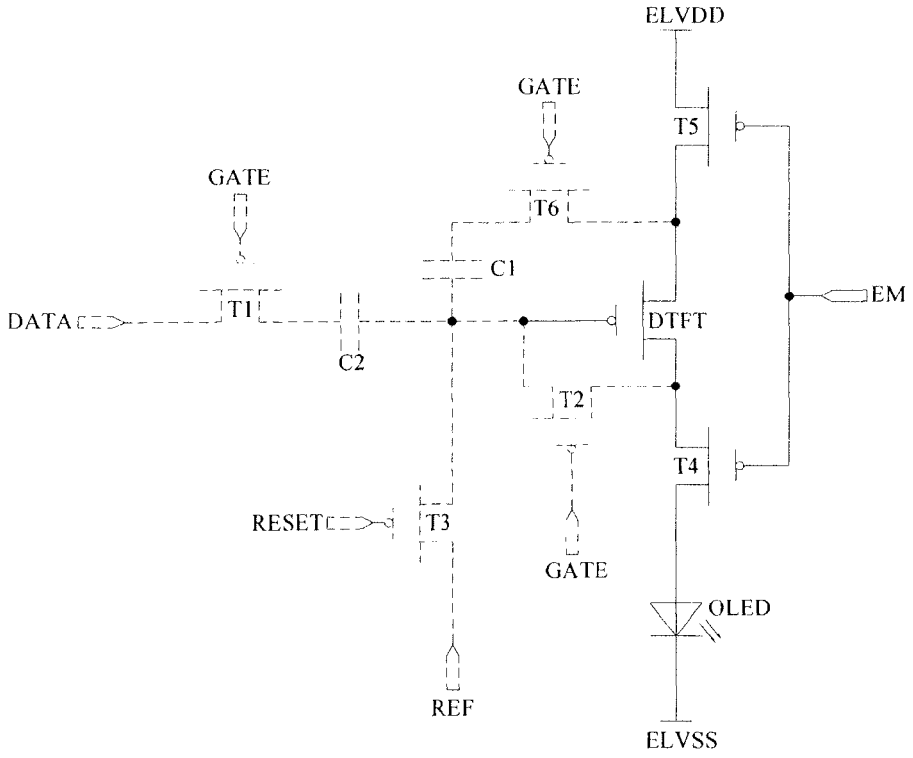
FIG. 6 is an equivalent circuit diagram of the pixel circuit shown in FIG. 2 during a t3 stage.

FIG. 6 illustrates an equivalent circuit diagram of the pixel circuit shown in FIG. 2 during the light-emitting stage of the light-emitting diode OLED (that is, the t3 stage shown in FIG. 3), as similar to FIGS. 4 and 5, parts drawn with solid lines denote powered-on parts while parts drawn with dotted lines denote powered-off parts.

The signal of the gate line GATE jumps to the high level, the first driving control transistor T1, the second driving control transistor T2 and the third driving control transistor T3 are turned off, the gate voltage $V_{data}+V_{ref}+V_{th,DTFT}$ of the driving thin film transistor DTFT is held by the first capacitor C1 and ensures that the driving thin film transistor operates in a saturation region. At this time, the output current $I_d$ of the driving thin film transistor DTFT is:

$$\begin{aligned} I_d &= \frac{1}{2}\mu C_{ox}(W/L)(|V_{gs,DTFT}| - |V_{th}|)^2 \\ &= \frac{1}{2}\mu C_{ox}(W/L)[V_{dd} - (V_{data} + V_{ref} - V_{th}) - V_{th}]^2 \\ &= \frac{1}{2}\mu C_{ox}(W/L)(V_{dd} - V_{data} - V_{ref})^2. \end{aligned}$$

It can be seen from above that the current $I_d$ flowing through the first electrode of the driving thin film transistor DTFT and the second electrode of the driving thin film transistor DTFT is independent of the threshold voltage $V_{th,DTFT}$ of the driving thin film transistor DTFT. Therefore a shift in the threshold voltage $V_{th,DTFT}$ of the driving thin film transistor DTFT would not affect a current output from the driving thin film transistor DTFT (that is, a drain current of the driving thin film transistor DTFT), so that the brightness of the light-emitting diode OLED would not be affected.

Meanwhile, during the light-emitting stage of the light-emitting diode OLED, the second light-emitting control transistor T4 is turned on, so the current $I_d$ flows into the light-emitting diode OLED through the second light-emitting control transistor T4 and the light-emitting diode OLED emits light for display.

Furthermore, the low level of the initialization unit 30 may be grounded. If a voltage drop caused by a wiring resistor or a parasitic resistor exists on the high level input terminal ELVDD of the driving power supply, the low level of the initialization unit 30 may be adjusted such that it may offset the voltage drop caused by the wiring resistor or the parasitic resistor. In this case, the pixel circuit may further compensate the voltage drop caused by the wiring resistor or the parasitic resistor in the driving power supply, in order to avoid fluctuations in the current $I_d$ due to the voltage drop caused by the wiring resistor or the parasitic resistor.

In another aspect of the present disclosure, there is further provided an organic light-emitting display, wherein the organic light-emitting display comprises the above pixel circuit provided in the embodiments of the present disclosure. Since the pixel circuits may output uniform currents, the brightness of light-emitting diodes in the pixel circuits is uniform, and in turn the display brightness of the organic light-emitting display comprising the pixel circuits is uniform.

It may be understood that the implementations described above are only exemplary implementations utilized to explain the principle of the present disclosure, but the present disclosure is not limited thereto. For those ordinary skilled in the art, many variances and improvements may be made without departing from the spirit and essential of the present disclosure, and such variances and improvements are intended to be included in the scope sought for protection of the present disclosure.

What is claimed is:

1. A pixel circuit comprising a driving thin film transistor and a light-emitting diode, wherein the light-emitting diode and the driving thin film transistor are connected between a low level input terminal and a high level input terminal of a driving power supply in series, wherein the pixel circuit further comprises a first capacitor and a driving control unit, and wherein the driving control unit is connected with a gate line and a data line and comprises a second driving control transistor and a third driving control transistor, wherein a gate of the second driving control transistor is connected with the gate line, a first electrode of the second driving control transistor is connected with the second electrode of the driving thin film transistor, a second electrode of the second driving control transistor is connected with the gate of the driving thin film transistor, a gate of the third driving control transistor is connected with the gate line, a first electrode of the third driving control transistor is connected with a first terminal of the first capacitor, and a second electrode of the third driving control transistor is connected with the first electrode of the driving thin film transistor, during a data writing stage, the third driving control transistor is turned on so as to connect the first terminal of the first capacitor to the first electrode of the driving thin film transistor and connect the gate of the driving thin film transistor to the second electrode of the driving thin film transistor, such that the driving thin film transistor is turned on.

2. The pixel circuit of claim 1, wherein the pixel circuit further comprises a second capacitor, wherein a first terminal thereof is connected with a second terminal of the first capacitor, and a second terminal of the second capacitor is electrically connected with the data line through the driving control unit.

3. The pixel circuit of claim 2 wherein the driving control unit further comprises a first driving control transistor, wherein a gate thereof is connected with the gate line, a first electrode thereof is connected with the data line, and a second electrode thereof is connected with the second terminal of the second capacitor.

4. The pixel circuit of claim 3, wherein the pixel circuit further comprises an initialization unit for providing a low level, wherein the initialization unit is connected to the second terminal of the first capacitor and the first terminal of the second capacitor.

5. The pixel circuit of claim 4, wherein the initialization unit comprises an initialization transistor, wherein a first electrode thereof is connected with the second terminal of the first capacitor and the first terminal of the second capacitor, a second electrode thereof is connected with the low level input terminal, and a gate thereof is connected with a reset signal input terminal.

6. The pixel circuit of claim 5, wherein the pixel circuit further comprises a light-emitting control unit, wherein the light-emitting control unit is connected with a light-emitting control line and is capable of connecting the high level input terminal of the driving power supply to the first electrode of the driving thin film transistor, and/or connecting the low level input terminal of the driving power supply to the second electrode of the driving thin film transistor, according to a signal supplied from the light-emitting control line.

7. The pixel circuit of claim 6, wherein the light-emitting control unit comprises a first light-emitting control transistor and a second light-emitting control transistor, wherein a gate of the first light-emitting control transistor is connected with the light-emitting control line, a first electrode of the first light-emitting control transistor is connected with the first electrode of the driving thin film transistor, a second electrode of the first light-emitting control transistor is connected with the high level input terminal of the driving power supply, a gate of the second light-emitting control transistor is connected with the light-emitting control line, a first electrode of the second light-emitting control transistor is connected with the second electrode of the driving thin film transistor, a second electrode of the second light-emitting control transistor is connected with an anode of the light-emitting diode, and a cathode of the light-emitting diode is connected with the low level input terminal of the driving power supply.

8. The pixel circuit of claim 7, wherein the driving thin film transistor, the first driving control transistor, the second driving control transistor, the third driving control transistor, the initialization transistor, the first light-emitting control transistor and the second light-emitting control transistor are all P-type transistors.

9. The pixel circuit of claim 1, wherein the pixel circuit further comprises a light-emitting control unit, wherein the light-emitting control unit is connected with a light-emitting control line and is capable of connecting the high level input terminal of the driving power supply to the first electrode of the driving thin film transistor, and/or connecting the low level input terminal of the driving power supply to the second electrode of the driving thin film transistor, according to a signal supplied from the light-emitting control line.

10. The pixel circuit of claim 9, wherein the light-emitting control unit comprises a first light-emitting control transistor and a second light-emitting control transistor, wherein a gate of the first light-emitting control transistor is connected with the light-emitting control line, a first electrode of the first light-emitting control transistor is connected with the first electrode of the driving thin film transistor, a second electrode of the first light-emitting control transistor is connected with the high level input terminal of the driving power supply, a gate of the second light-emitting control transistor is connected with the light-emitting control line, a first electrode of the second light-emitting control transistor is connected with the second electrode of the driving thin film transistor, a second electrode of the second light-emitting control transistor is connected with an anode of the light-emitting diode, and a cathode of the light-emitting diode is connected with the low level input terminal of the driving power supply.

11. An organic light-emitting display, wherein the organic light-emitting display comprises the pixel circuit of claim 1.

12. The organic light-emitting display of claim 11, wherein the pixel circuit further comprises a second capacitor, wherein a first terminal thereof is connected with the second terminal of the first capacitor, and a second terminal thereof is electrically connected with the data line through the driving control unit.

13. The organic light-emitting display of claim 12, wherein the driving control unit further comprises a first driving control transistor, wherein a gate thereof is connected with the gate line, a first electrode thereof is connected with the data line, and a second electrode thereof is connected with the second terminal of the second capacitor.

14. The organic light-emitting display of claim 13, wherein the pixel circuit further comprises an initialization unit for providing a low level, wherein the initialization unit is connected to the second terminal of the first capacitor and the first terminal of the second capacitor.

15. The organic light-emitting display of claim 14, wherein the initialization unit comprises an initialization transistor, wherein a first electrode thereof is connected with the second terminal of the first capacitor and the first terminal of the second capacitor, a second electrode thereof is connected with the low level input terminal, and a gate thereof is connected with a reset signal input terminal.

16. The organic light-emitting display of claim 11, wherein the pixel circuit further comprises a light-emitting control unit, wherein the light-emitting control unit is connected with a light-emitting control line and is capable of connecting the high level input terminal of the driving power supply to the first electrode of the driving thin film transistor, and/or connecting the low level input terminal of the driving power supply to the second electrode of the driving thin film transistor, according to a signal supplied from the light-emitting control line.

17. The organic light-emitting display of claim 16, wherein the light-emitting control unit comprises a first light-emitting control transistor and a second light-emitting control transistor, wherein a gate of the first light-emitting control transistor is connected with the light-emitting control line, a first electrode of the first light-emitting control transistor is connected with the first electrode of the driving thin film transistor, a second electrode of the first light-emitting control transistor is connected with the high level input terminal of the driving power supply, a gate of the second light-emitting control transistor is connected with the light-emitting control line, a first electrode of the second light-emitting control transistor is connected with the second electrode of the driving thin film transistor, a second electrode of the second light-emitting control transistor is connected with an anode of the light-emitting diode, and a cathode of the light-emitting diode is connected with the low level input terminal of the driving power supply.

* * * * *